US006245225B1

(12) United States Patent
Giersberg

(10) Patent No.: US 6,245,225 B1
(45) Date of Patent: Jun. 12, 2001

(54) STEPPED FILTRATION DEVICE FOR MECHANICALLY SEPARATING SOLIDS FROM LIQUIDS

(75) Inventor: Alfred Giersberg, Bergkamen (DE)

(73) Assignee: Egner Umwelttechnologie GmbH, Adelsheim (DE)

( * ) Notice: Subject to any disclaimer, the term of this patent is extended or adjusted under 35 U.S.C. 154(b) by 0 days.

(21) Appl. No.: 09/423,492

(22) PCT Filed: Apr. 29, 1998

(86) PCT No.: PCT/DE98/01184

§ 371 Date: May 18, 2000

§ 102(e) Date: May 18, 2000

(87) PCT Pub. No.: WO98/50638

PCT Pub. Date: Nov. 12, 1998

(30) Foreign Application Priority Data

May 7, 1997 (DE) ..... 197 19 371

(51) Int. Cl.[7] ..... E02B 5/08

(52) U.S. Cl. ..... 210/154; 210/155; 210/159; 210/162

(58) Field of Search ..... 210/154, 155, 210/159, 162, 357

(56) References Cited

U.S. PATENT DOCUMENTS 1,751,421 3/1930 Reid .
1,773,576 * 8/1930 Downes .
5,098,561 * 3/1992 Grabbe .
5,456,826 * 10/1995 Mellegard .
5,770,055 * 6/1998 Wallander et al. .
6,139,728 * 10/2000 Huber .

FOREIGN PATENT DOCUMENTS 4001859 8/1996 (DE) .
29700382 3/1997 (DE) .
98820 * 6/1983 (EP) .
9424373 10/1994 (WO) .

* cited by examiner

*Primary Examiner*—Thomas M. Lithgow
(74) *Attorney, Agent, or Firm*—Horst M. Kasper

(57) ABSTRACT

A staged filter apparatus (1) for mechanically separating solids from liquids flowing in channels, gutters or conduits, which has a multiplicity of stage screen bars (7') connected to form a stationary grating (7), and a multiplicity of stage screen bars (6') connected to form a movable grating (6), the gratings (6, 7) being arranged inclined in the direction of flow inside the flowing liquid starting from a level situated below the surface, and the stage screen bars (6', 7') being constructed in a stepped fashion in the direction facing the incoming flow, and in which the movable grating (6) can be actuated by means of a drive device (8) on a track. The stationary grating (7) being surrounded at least laterally by frame parts (3, 4), is distinguished in that all the drive elements (11, 12, 19; 13) of the movable grating (6) are essentially arranged in the common plane formed by the stationary grating (7) and the movable grating (6) in the zero position.

8 Claims, 3 Drawing Sheets

STEPPED FILTRATION DEVICE FOR MECHANICALLY SEPARATING SOLIDS FROM LIQUIDS

TECHNICAL FIELD

The present invention relates to a staged filter apparatus for mechanically separating solids from liquids flowing in channels, gutters or conduits, which has a multiplicity of stage screen bars connected to form a stationary grating, and a multiplicity of stage screen bars connected to form a movable grating, the gratings being arranged inclined in the direction of flow inside the flowing liquid starting from a level situated below the surface, and the stage screen bars being constructed in a stepped fashion in the direction facing the incoming flow, and in which the movable grating can be actuated by means of a drive device on a track which, starting from a zero position which is identical in the vertical and horizontal directions to the stationary grating, permits a stroke movement which rises over the stages of the stage screen bars connected to form the stationary grating and against the direction facing the incoming flow, and which reaches at least to a position identical in the vertical direction and in the horizontal direction to the next higher stage of the stationary grating, and subsequently guides the stage screen bars of the movable grating below the stationary grating back into the zero position, the stationary grating being surrounded at least laterally by frame parts.

PRIOR ART

Such apparatuses are known as stage screens and serve the purpose inside sewage or separation plants of removing solids present in sewage.

EP 0 098 820 has disclosed a stage filter in which the drive device is present on the top side of the gratings, the movement of the movable grating being transmitted via an eccentric wheel and a support device which is connected to said eccentric wheel and embraces the stationary grating from above and outside.

The customary designs of such devices have the disadvantage that a relatively large overall height is provided in each case. Given a relatively large stroke of such screens, which reaches over a plurality of stages, the drive elements are fitted far above the gratings so that sufficient headroom is still available for the passage even of relatively large solid bodies between the drive element and the moving gratings. However, such a construction also entails corresponding dimensioning of the channel cross-sections and the intakes, which in turn substantially increases the outlay and the costs for setting up the intake structures for, for example, sewage plants.

DE 40 01 859 C2 has disclosed a filter screen for removing solid constituents from flowing liquids, in which there is arranged below the grating bars a crank drive which controls the movement of the movable grating bars. The selected lever arrangement is supported in this case on skids which are mounted in guide sections of the supporting structure.

WO 94/24373 has disclosed a staged filter screen in which the movable grating is connected eccentrically on the top side to a wheel, there being connected to said wheel, likewise eccentrically, a long thin rod which, in turn, is mounted on the frame at the other end region via chains, and thereby transmits a type of elliptical rotary movement onto the movable grating in this region. Since an essentially circular movement of the individual stages proceeds in the region of the upper eccentric connection of the movable grating and an elliptical movement proceeds in the lower region, the course of the stage screen bars in the longitudinal direction necessitates different section designs in order to ensure reliable removal. Furthermore, the chain bearing of the connecting rod is not optimum in the lower region as regards permanently reliable functioning.

SUMMARY OF THE INVENTION

Proceeding from said prior art, the invention is based on the object or the technical problem of proposing a stage screen in which the space requirement necessary for reliable operation is minimized and, at the same time, the passage of even relatively large solid bodies is rendered possible without any problem in conjunction with an arbitrarily steep inclination in the direction of flow. In this case, the construction is intended to be of simple, robust and low-maintenance design.

The staged filter apparatus according to the invention is given by the features of the independent claim 1. Advantageous refinements and developments are covered by the dependent claims.

The device according to the invention for mechanically separating solids from liquids is therefore distinguished in that all the drive elements of the movable grating are essentially arranged in the common plane formed by the stationary grating and the movable grating in the zero position.

The result of such a construction of the apparatus is a modular design in which the entire apparatus including the drive can be installed and operated as components which are immediately ready to function inside channel cross-sections which are bounded only by the simplest lateral structures or lateral holding constructions, without the need to set up complicated structures or gutter guides, machine boxes or housings, controls or gear internals or devices for accessory parts.

The modular design likewise permits easy installation in already existing systems, for example when wear in the old plant necessitates replacement of the screen devices, and is therefore eminently suitable for adapting gutter cleaning systems to sewage fractions which have changed in the course of recent decades, for example, but also to new statutory regulations regarding the further disposal of the treated waters.

Moreover, owing to the arrangement of the drive elements of the movable grating essentially in the common plane formed by the stationary grating and the movable grating in the zero position, it is possible to realize any desired angular positions of the apparatus, so that it is possible to provide a withdrawal stroke adapted more or less steeply to the expected size of the solid fraction. Since all the drive elements are accommodated inside the module, sufficient space to pass remains as headroom above the screen bars despite a serious reduction in installation space and outlay on construction.

It is advantageous for the drive elements to include driven wheels mounted in a frame of the stationary grating, the movable grating being pivoted at the wheels in an eccentric fashion and radially relative to the wheel axle.

Such a construction permits minimization and the encapsulation and integration of the drive elements inside supporting, in particular hollow frame parts, with the result that such drive elements can also be arranged below the water level and only rotary bushings which are easy to seal need be provided.

A virtually maintenance-free design can be achieved by virtue of the fact that the drive elements include driven lateral cheeks mounted in a frame of the stationary grating, the movable grating being pivoted in an eccentric fashion at the cheeks at a point spaced apart from the bearing. Such a drive can be produced in a very simple way and requires to be monitored only visually. The work of repair and/or replacement can be carried out in a simple way.

In a further advantageous design, the drive is performed via chain drives or cardan shafts acting on the wheels/cheek (s) . Such a construction lends support to the compact design and permits large forces to be reliably transmitted, as a result of which it is also possible to manage bulky and heavy removals without any problem.

A further design measure, which is effective with a view to a compact modular design and is advantageous in the apparatus consists in that at its outermost positions, the movement track from the zero position to the higher stage and back leaves the plane defined by the stationary grating by no more than double the stage height. The required moving members and moving guides can then be designed in cooperation with the chain drives or cardan shafts already mentioned to be of relatively small construction.

Further embodiments and advantages of the invention follow from the features further set forth in the claims, as well as from the exemplary embodiments specified below. The features of the claims can be combined with one another in any desired way if they are not evidently mutually exclusive.

BRIEF DESCRIPTION OF THE DRAWINGS

The invention a s well as advantageous embodiments and developments of the same are described in more detail and explained below with the aid of the examples represented in the drawing. The features to be gathered from the description and the drawing can be applied according to the invention individually per se or as a plurality in an arbitrary combination. In the drawing.

WAYS OF IMPLEMENTING THE INVENTION

Figure 1:
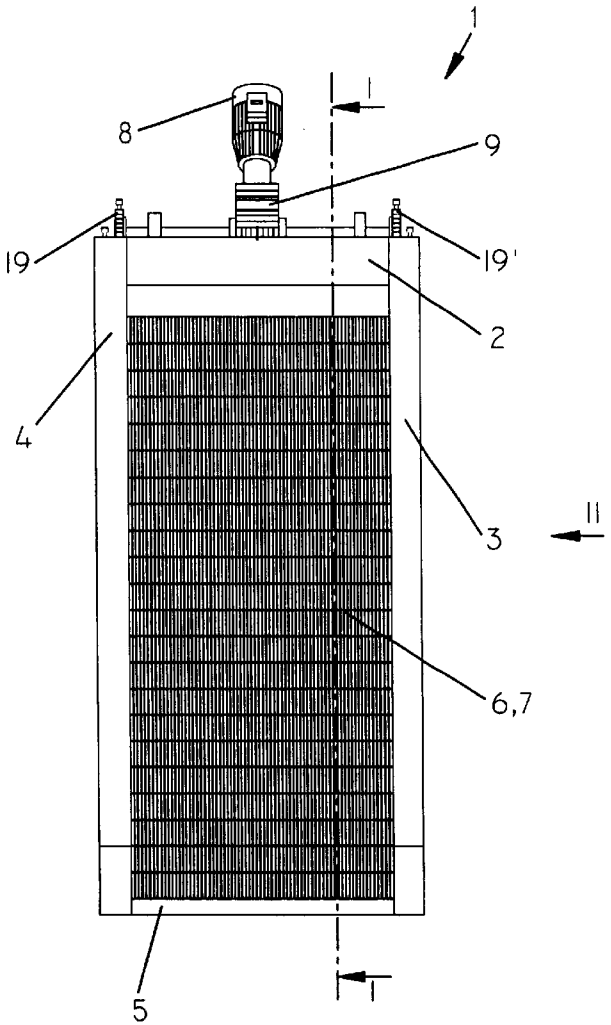
FIG. 1 shows an apparatus constructed as a stage screen for mechanically separating solids, in a front view (in the direction of the gutter axis)

Represented in FIG. 1 is an apparatus, constructed as a stage screen 1, for mechanically separating solids in whose frame, which comprises the lateral frame parts 3, 4, the upper frame part 2 and the lower frame part 5, the stage screen bars of a movable grating 6 are arranged between the stage screen bars of a stationary grating 7.

Figure 2:
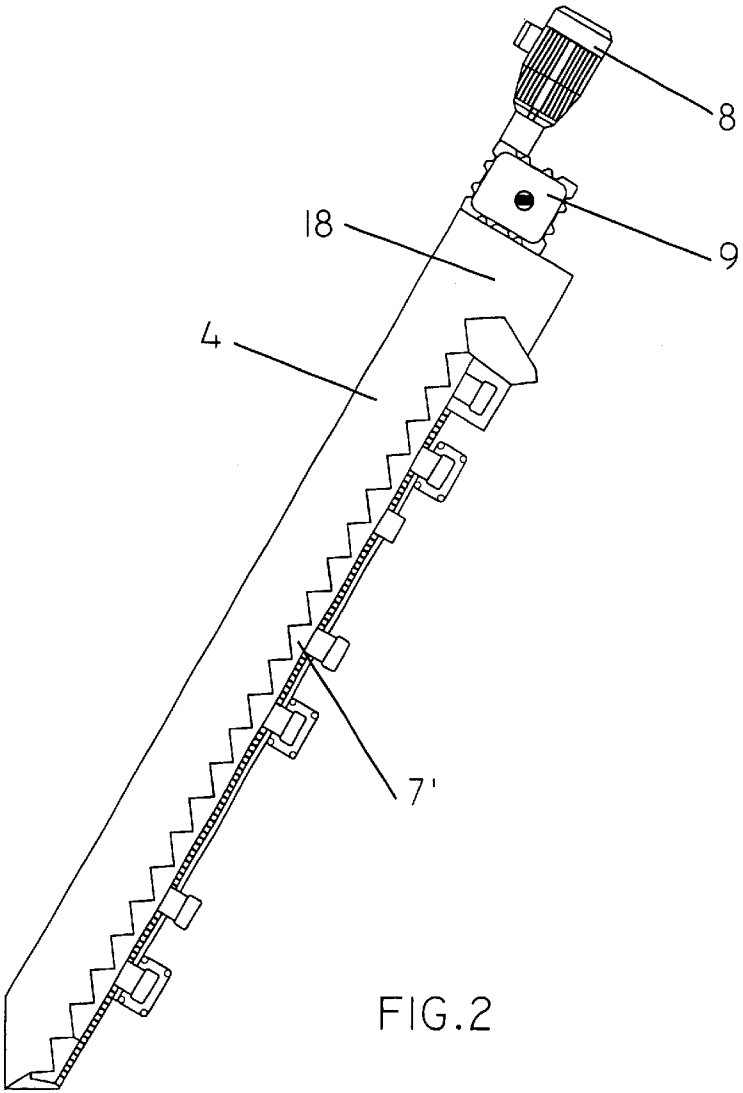
FIG. 2 shows the screen bars, connected to a stationary grating, in the sectional view A—A marked in FIG. 1.

The arrangement of the stage screen bar(s) relative to the frame part 4 is to be seen in the synopsis with FIG. 2 and the side view, represented there within the section A—A of FIG. 1, of a stage screen bar 7' of the stationary grating 7.

Figure 3:
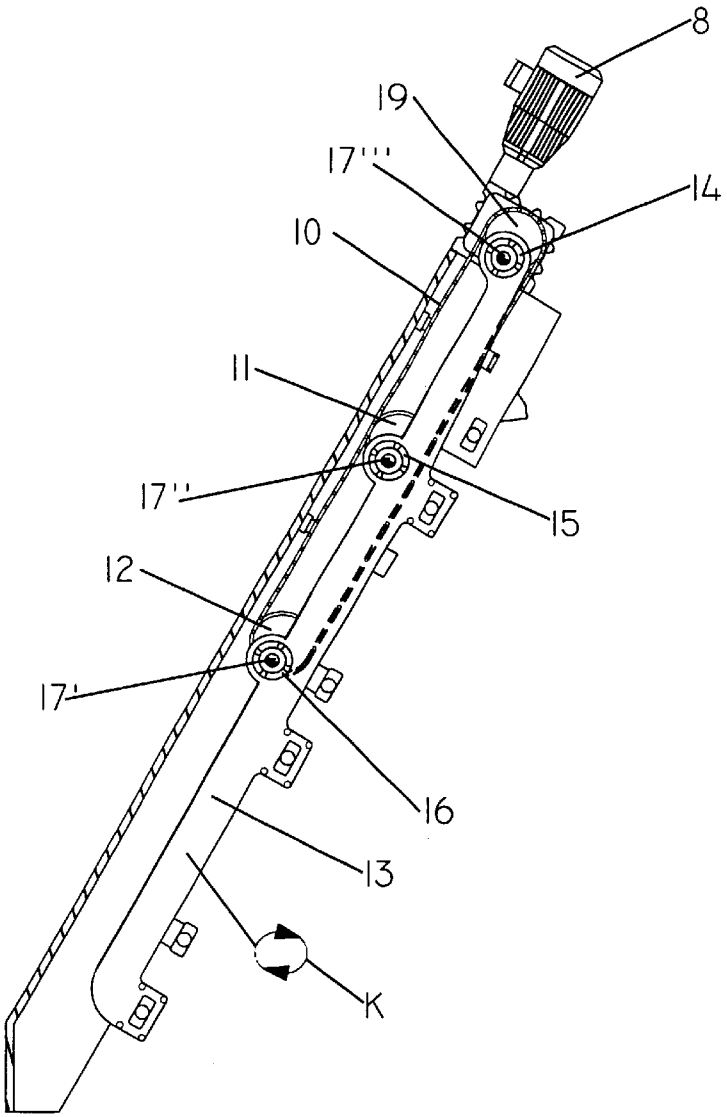
FIG. 3 shows the screen bars, connected to form a movable grating, with a chain drive on the frame of the stationary grating.

Present on the top side is an electric motor 8 which is flanged to a gear box 9. The electric motor 8 is fastened with the gear box 9 on the upper end of the frame, that is to say on the head plate constructed as frame part 2, and drives, via the chain drive 10 represented in FIG. 3, three sprocket wheels 11, 12, 19 which are spaced apart from one another in one plane, run essentially parallel along an imaginary connecting line to the external frame part 3, 4, and are arranged rotatably on the frame part 3, 4. The sprocket wheels 11, 12, 19 have eccentric cams 17 via which an external, lateral cheek 13 is connected eccentrically on both sides of the frame parts 3, 4. The lateral cheeks 13 are connected via a substructure not represented in more detail to the movable stage screen bars 6' of the movable grating 6. The lateral cheek 13 and thus also all the stage screen bars 6' carry out the circular movement K indicated in FIG. 3 by virtue of this pivoting.

The stage screen bars 6' are of identical construction to the stage screen bars 7' and—seen from the side—are situated next to one another in the zero position in a fully coincident fashion and in each case between the stage screen bars 7'. The lateral cheeks 13 are also located in the same position, on the outside. Said cheeks execute the same movement as the stage screen bars 6' of the movable grating 6.

The lateral cheek 13 is mounted in the pivot-joint bearing flanges 14, 15 and 16, whose axes are formed by the eccentric cams 17' to 17''', as a result of which the movable grating 6 can be actuated on a track K which, starting from a zero position which is identical in the vertical and horizontal directions to the screen bars 7' of the stationary grating 7, permits a stroke movement which reaches at least to a position identical in the vertical and horizontal directions to the next higher stage of the stationary grating 7, and subsequently guides the screen bars 6' of the movable grating 6 below the stationary grating 7 back into the zero position. As a result of this stroke movement, material to be removed is reliably conveyed upwards either from the gutter surface or from the gutter base, and discarded through the opening 18 present below the sprocket wheel 19 onto appropriate devices leading further.

Such a stage screen minimizes the space required for reliable operation and permits even relatively large solid bodies to pass without a problem in the case of inclination in the direction of flow which is simultaneously arbitrarily steeper.

Provision of movable lateral cheeks which, seen in a lateral view, are present in a fashion which virtually coincides with the movable stage screen bars, it is possible to implement a compact design which ensures permanently reliable functioning and is very easy to maintain.

What is claimed is:

1. Staged filter apparatus (1) for mechanically separating solids from liquids flowing in channels, gutters or conduits, which has a multiplicity of stage screen bars (7') connected to form a stationary grating (7), and a multiplicity of stage screen bars (6') connected to form a movable grating (6), the gratings (6, 7) being arranged inclined in the direction of flow inside the flowing liquid starting from a level situated below the surface, and the stage screen bars (6', 7') being constructed in a stepped fashion in the direction facing the incoming flow, and in which the movable grating (6) can be actuated by means of a drive device (8) on a track which, starting from a zero position which is identical in the vertical and horizontal directions to the stationary grating (7), permits a stroke movement which rises over the stages of the stage screen bars (7') connected to form the stationary grating (7) and against the direction facing the incoming flow, and which reaches at least to a position identical in the vertical direction and in the horizontal direction to the next higher stage of the stationary grating (7), and subsequently guides the stage screen bars (6') of the movable grating (6) below the stationary grating (7) back into the zero position, the stationary grating (7) being surrounded at least laterally by frame parts (3, 4), characterized in that all the drive elements (11, 12, 19; 13) of the movable grating (6) are essentially arranged in the common plane formed by the stationary grating (7) and the movable grating (6) in the zero position.

2. Apparatus for mechanically separating solids according to claim 1, characterized in that the drive elements (11, 12, 19) include driven wheels (11, 12, 19) mounted on the frame parts (3, 4) of the stationary grating (7), the movable grating (6) being pivoted at the wheels (11, 12, 19) in an eccentric fashion and radially relative to the wheel axle.

3. Apparatus for mechanically separating solids according to claim 2, characterized in that the movable grating (6) is connected to at least one, or optionally two, cheek(s) (13) running essentially parallel to the frame parts (3, 4), and the cheek(s) (13) is/are connected to the wheels (11, 12, 19) in an eccentrically rotatable fashion in the manner of a connecting rod.

4. Apparatus for mechanically separating solids according to claim 3, characterized in that the drive is performed via chain drives (10) acting on the wheels (11, 12, 19) and/or cheek(s).

5. Apparatus for mechanically separating solids according to claim 3, characterized in that the drive is performed via cardan shafts acting on the wheels and/or cheek(s).

6. Apparatus for mechanically separating solids according to claim 1, characterized in that at its outermost positions, the movement track from the zero position to the higher stage and back leaves the plane defined by the stationary grating (7) by no more than double the stage height of the stage screen bars.

7. Apparatus for mechanically separating solids according to claim 3, characterized in that the cheek(s) (13) is/are pivoted on the outside at the lateral frame part(s) (3, 4).

8. Apparatus for mechanically separating solids according to claim 3, characterized in that seen in a side view, the cheek(s) is/are present essentially in the same position as the stage screen bars (6') of the movable grating (6).

* * * * *